US007516562B2

(12) United States Patent
Signori

(10) Patent No.: US 7,516,562 B2
(45) Date of Patent: Apr. 14, 2009

(54) MULTI-FUNCTION CYCLING SHOE

(75) Inventor: Dino Signori, Maser (IT)

(73) Assignee: Sidi Sport S.R.L., Maser (TV) (IT)

( * ) Notice: Subject to any disclaimer, the term of this patent is extended or adjusted under 35 U.S.C. 154(b) by 503 days.

(21) Appl. No.: 11/371,471

(22) Filed: Mar. 9, 2006

(65) Prior Publication Data

US 2006/0201035 A1 Sep. 14, 2006

(30) Foreign Application Priority Data

Mar. 11, 2005 (IT) ..... PD2005A0072

(51) Int. Cl.
*A43B 5/14* (2006.01)

(52) U.S. Cl. ..... 36/131

(58) Field of Classification Search ..... 36/131, 36/134; 74/594.4

See application file for complete search history.

(56) References Cited

U.S. PATENT DOCUMENTS

| | | | | |
|---|---|---|---|---|
| 4,506,463 | A * | 3/1985 | Chassaing | 36/131 |
| 4,538,480 | A * | 9/1985 | Trindle | 36/131 |
| 5,079,968 | A * | 1/1992 | Starner | 36/131 |
| 5,125,173 | A | 6/1992 | Nagano et al. | |
| 6,164,158 | A | 12/2000 | Landru et al. | |
| 2005/0210712 | A1 * | 9/2005 | Jau et al. | 36/131 |
| 2006/0016102 | A1 * | 1/2006 | Xie | 36/131 |

* cited by examiner

*Primary Examiner*—Ted Kavanaugh
(74) *Attorney, Agent, or Firm*—RatnerPrestia

(57) ABSTRACT

A multi-function cycling shoe includes a sole in which a fixing device is provided for a pedal attachment device. The sole includes a pair of projections of predetermined thickness which are fitted removably to the sole laterally and which stand out above the fixing device to form, when fitted to the sole, a recess to protect the fixing device and the pedal attachment device from impact with the ground, and to enable an attachment device for road racing to be mounted when these projections are removed from the sole.

9 Claims, 2 Drawing Sheets

MULTI-FUNCTION CYCLING SHOE

BACKGROUND OF THE INVENTION

The invention relates to a multi-function cycling shoe of the type having a fixing device for a pedal attachment device.

In the field of cycling, there is a known way of producing a shoe whose sole is provided with a fixing device for receiving various cleats so that the user can adapt any pedal attachment of his choice to the same shoe. It is also known that various sports within the field of cycling, for example road racing, off-road cycling (mountain biking) and indoor training (spinning) require entirely different soles and/or cleats.

For example, for road or track cycling use is made of shoes of the type described in U.S. Pat. No. 6,164,158, with substantially flat soles having no projections, to the underside of which a cleat of a certain size is fixed; for cycling on unmade roads, shoes of the type described in U.S. Pat. No. 5,125,173 are used, with "clawed" soles, provided with a pair of projections of predetermined thickness running laterally and standing out above the cleat fixing device to form a recess to protect the device and the cleat from impact with the ground; while, for indoor training, shoes with essentially flat rigid soles, without any special projections or cleats, are used.

It is therefore necessary to provide, for a single model of shoe, different versions which are substantially identical in respect of their uppers, but which differ in respect of the soles used.

This prior art creates considerable difficulties both for the cyclist, who has to purchase different shoes which are only really differentiated by a short portion of the sole, and for the manufacturer, who has to produce and stock a plurality of versions of the same model of shoe to meet the different requirements of cyclists.

BRIEF SUMMARY OF THE INVENTION

The fundamental problem overcome by the invention is that of providing a shoe whose structural and functional design is such that all the difficulties of the aforementioned prior art can be overcome. Within the ambit of this problem, an important object of the invention is to provide a shoe which can be used satisfactorily for quite different sports in the cycling field, in an optimal way and with modest practical adaptations.

The present invention relates to a multi-function cycling shoe including a sole with a fixing means for a pedal attachment device. The sole has a pair of projectors of predetermined thickness which are removeably fitted to the sole laterally and which stand out above the fixing means to form, when fitted to the sole, a recess to protect the fixing means and the pedal attachment device from impact with the ground, and to enable an attachment device for road racing, to be mounted when the projections are removed from the sole.

BRIEF DESCRIPTION OF THE DRAWINGS

The characteristics and advantages of the invention will be made clearer by the following detailed description of a preferred, but not exclusive, example of an embodiment of the invention, illustrated, for the purposes of guidance and without restrictive intent, with reference to the attached drawings, in which.

DETAILED DESCRIPTION OF THE INVENTION

Figure 1:
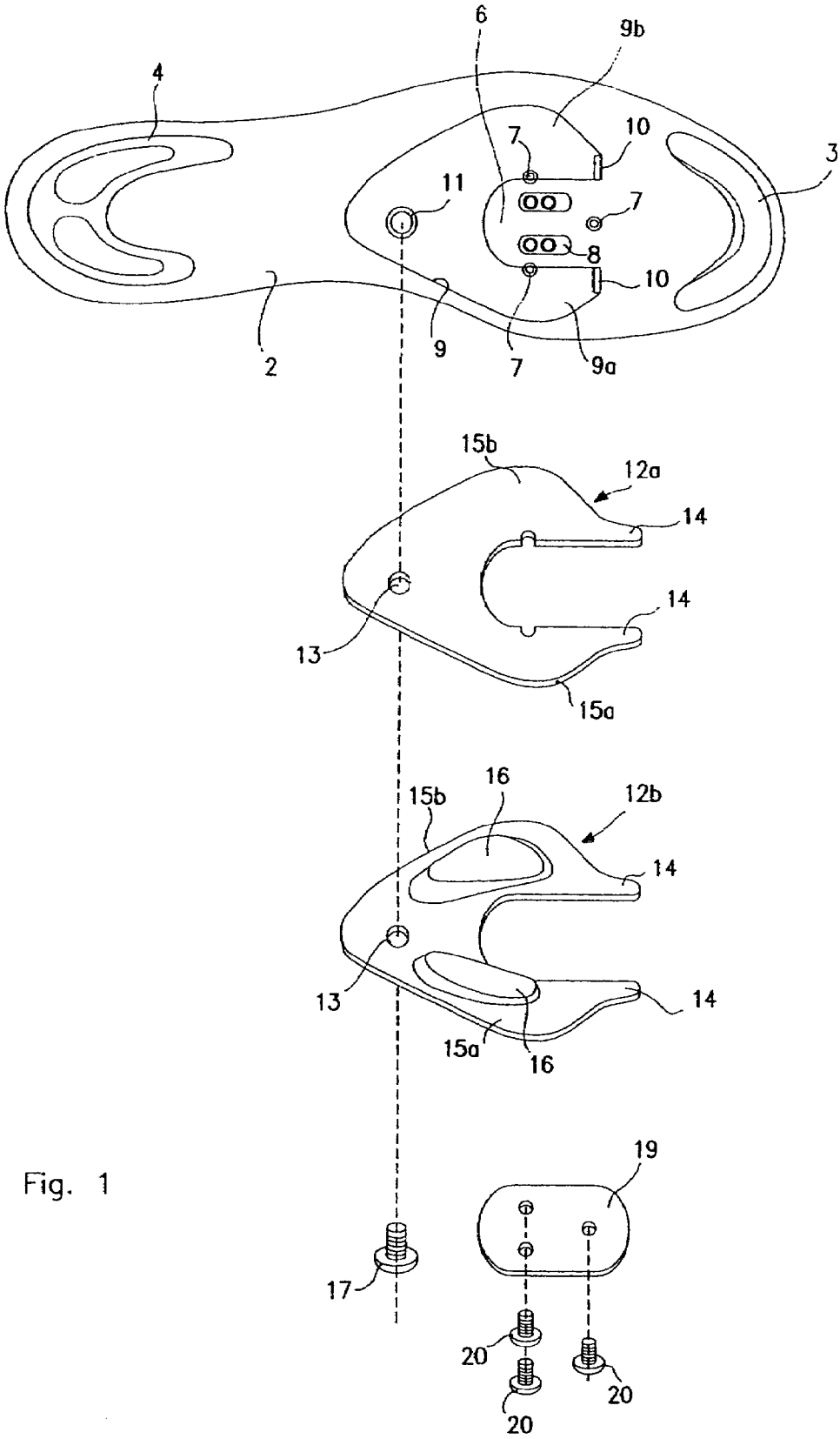
FIG. 1 is a perspective view of a cycling shoe according to the invention, with parts detached.
Figure 2:
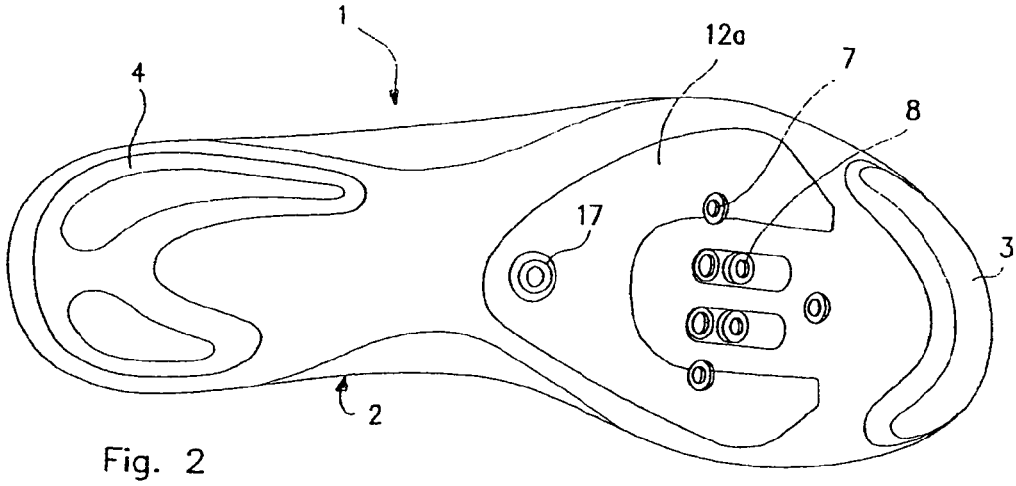
FIG. 2 is plan view from below of the shoe of FIG. 1, equipped for road racing.
Figure 3:
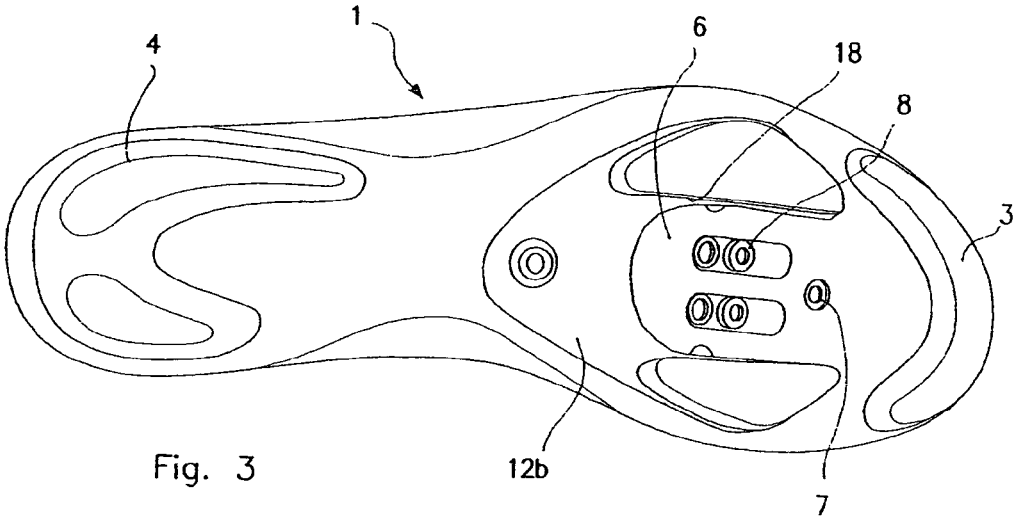
FIG. 3 is plan view from below of the shoe of FIG. 1, equipped for off-road cycling.
Figure 4:
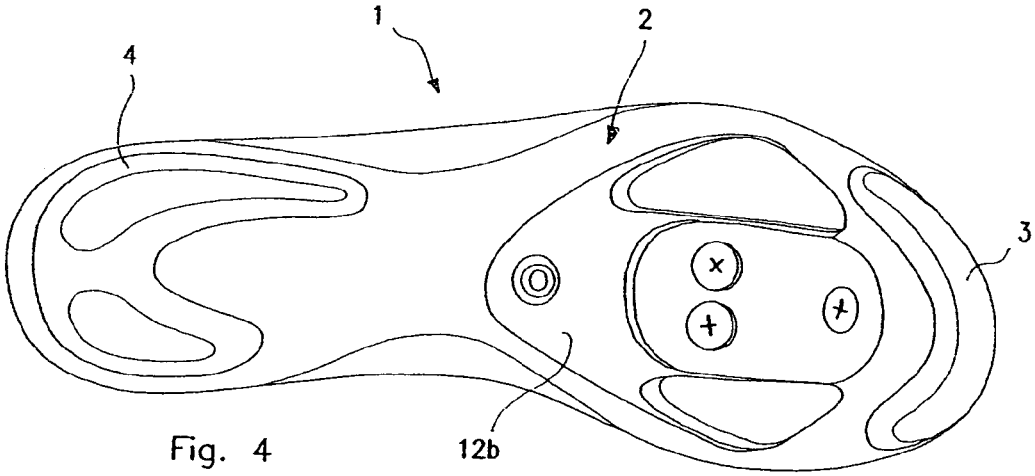
FIG. 4 is plan view from below of the shoe of FIG. 1, equipped for indoor training.

In the figures, the number 1 indicates the whole of a cycling shoe according to the invention, including a substantially rigid or semi-rigid sole 2. In the sole there are a toe area and a heel area having relief portions 3 and 4 respectively, together with an arch area 6 intermediate between the foregoing, and in which the sole has fixing means 7 and 8 for a pedal attachment device which is not illustrated, since it is of a known type. This device can comprise, for example, a cleat of the type described in U.S. Pat. No. 5,125,173 or of the type described in U.S. Pat. No. 6,164,158. In the first case, the cleat is fixed by the fixing means 8, consisting of threaded holes formed in a plate which is movable along the longitudinal axis running from the toe to the heel of the shoe. The holes are accessible through slotted apertures in the sole.

In the second case, the cleat is fixed by the fixing means 7, consisting of threaded inserts fixed in the sole.

The sole also has a V-shaped recess with its vertex facing the heel and with two prongs 9*a* and 9*b* at whose ends near the toe there is formed a corresponding cavity 10. An insert 11 with a female thread is placed in the proximity of the vertex of the recess 9.

The recess 9 forms a housing for receiving a plate, preferably made of metal, which is at least partially embedded. According to the invention, two interchangeably replaceable plates are provided in the recess 9. The first plate, indicated by 12*a*, is substantially flat and is intended for use on roads or on tracks. The plate 12*a* is shaped to mate with the recess 9, and has a V-shaped configuration, with a hole 13 at a position corresponding to the insert 11 and with tabs 14 extending at the free ends of the prongs 15*a* and 15*b*, and capable of engaging in the cavities 10 to fix the plate 12*a* in the housing 9. The plate 12*a* is locked in the housing 9 by means of a screw 17 which is received in the female thread of the insert 11 and passes through the hole 13.

The second plate, indicated by 12*b*, has an identical V-shape, the details of which are identified by the same reference numbers as those of the plate 12*a*, and also has a pair of projections 16 for which it forms a common support. The projections 16 have a predetermined thickness and extend along each prong 15*a* and 15*b* laterally and which stand out above the fixing means 7 so as to form, when the plate 12*b* is fitted to the sole, a recess 18 in which the means 7 and the cleat fitted to it are protected from impact with the ground.

The invention also comprises a buffer 19 which can be fitted removeably by means of screws 20 to the fixing means 7 and 8 to close the recess 18, particularly but not exclusively for the use of the shoe in indoor training. This buffer is used in combination with the plate 12*b*.

It can be seen in the figures that the plate 12*a* has, on facing edges of the prongs, corresponding notches for access to the holes 8. It is also possible for the plate 12*a* to be omitted entirely, or to be integrated in the sole 2.

To adapt the shoe 1 for different uses, it is simply necessary to fit the most suitable plate for the desired use into the recess 9 of the shoe, and, if the shoe is used for spinning, to fit the buffers 19 in place of the normal cleats.

Thus the invention resolves the problem which was presented, and achieves numerous advantages over the prior art.

In particular, it enables the user to adapt a single shoe for different forms of cycling sport with ease, in a few moments, and in an entirely reversible way.

The invention claimed is:

1. A multi-function cycling shoe comprising:

a sole in which fixing means are provided for a pedal attachment device, the sole includes:

a pair of projections of predetermined thickness which are removably fitted to the sole laterally and which stand out above the fixing means to form, when fitted to the sole, and a recess to protect the fixing means and the pedal attachment device from impact with the ground, and to enable an attachment device for road racing to be mounted when the projections are removed from the sole; and a single platelike and fork-shaped support, the support having prongs extending parallel to a longitudinal axis of the sole on juxtaposed sides of the fixing means, the prongs adapted to be fixed removably to the sole, wherein one end of the support is fixed removably to the sole with a single screw.

2. The cycling shoe according to claim 1, additionally comprising a buffer which can be fitted removably to the said fixing device to close the recess.

3. The cycling shoe according to claim 1, in which the support is received and at least partially embedded in a housing formed in the sole.

4. The cycling shoe according to claim 1, in which the support with the projections is interchangeably replaceable with a plate having a shape substantially identical to that of the support without projections.

5. The cycling shoe according to claim 1, in which the support has, at a free end of each said prong, a tab formation which can be received in a corresponding cavity in the sole, to keep one end of the support fixed to the sole.

6. The cycling shoe according to claim 3, in which the support has, at a free end of each said prong, a tab formation which can be received in a corresponding cavity in the sole, to keep one end of the support fixed to the sole.

7. The cycling shoe according to claim 3, in which the support with the projections is interchangeably replaceable with a plate having a shape substantially identical to that of the support without projections.

8. The cycling shoe according claim 1, in which the support has a tab formation which can be received in a corresponding cavity in the said sole, to keep one end of the support fixed to the sole.

9. The cycling shoe according to claim 8, in which the support with the projections is interchangeably replaceable with a plate having a shape substantially identical to that of the support without projections.

* * * * *